US006080291A

United States Patent [19]

Woodruff et al.

[11] Patent Number: 6,080,291

[45] Date of Patent: Jun. 27, 2000

[54] APPARATUS FOR ELECTROCHEMICALLY PROCESSING A WORKPIECE INCLUDING AN ELECTRICAL CONTACT ASSEMBLY HAVING A SEAL MEMBER

[75] Inventors: Daniel J. Woodruff; Kyle M. Hanson, both of Kalispell, Mont.

[73] Assignee: Semitool, Inc., Kalispell, Mont.

[21] Appl. No.: 09/113,723

[22] Filed: Jul. 10, 1998

[51] Int. Cl.[7] ..... C25D 17/04; C25D 17/06

[52] U.S. Cl. ..... 204/297.01; 204/212

[58] Field of Search ..... 204/297 R

[56] References Cited

U.S. PATENT DOCUMENTS

| | | | |
|---|---|---|---|
| 4,246,088 | 1/1981 | Murphy et al. . | |
| 4,259,166 | 3/1981 | Whitehurst . | |
| 4,304,641 | 12/1981 | Grandia et al. | 204/228 |
| 4,466,864 | 8/1984 | Bacon et al. . | |
| 5,135,636 | 8/1992 | Yee et al. | 205/96 |
| 5,227,041 | 7/1993 | Brogden et al. | 204/297 R |
| 5,441,629 | 8/1995 | Kosaki . | |
| 5,744,019 | 4/1998 | Ang | 205/96 |

FOREIGN PATENT DOCUMENTS

WO 99/25904 5/1999 WIPO .

*Primary Examiner*—Kathryn Gorgos
*Assistant Examiner*—Erica Smith-Hicks
*Attorney, Agent, or Firm*—Rockey, Milnamow & Katz, Ltd.

[57] ABSTRACT

A plating apparatus, such as for electroplating of semiconductor wafers or like workpieces, includes a plating contact including an annular contact ring having an annular mounting portion, and an annular electrically-conductive contact portion extending inwardly of the mounting portion. The contact portion is configured for substantially continuous electrically-conductive contact with a peripheral region of the associated workpiece. The arrangement further includes an annular seal member mounted on the annular contact ring, with the seal member including a resiliently deformable annular seal lip portion adjacent to the contact portion of the contact ring. The seal lip is resiliently biased into continuous sealing engagement with the peripheral region of the workpiece when the workpiece is positioned in electrically-conductive contact with the contact ring. The apparatus includes a rotor assembly configured to receive the workpiece, and move the workpiece into operative contact with the annular contact ring and the annular seal member.

8 Claims, 13 Drawing Sheets

APPARATUS FOR ELECTROCHEMICALLY PROCESSING A WORKPIECE INCLUDING AN ELECTRICAL CONTACT ASSEMBLY HAVING A SEAL MEMBER

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

The present invention relates generally to an electroplating apparatus for plating of semiconductor components, and more particularly to an electroplating apparatus, including a plating contact configured to make substantially continuous contact with an associated semiconductor workpiece, with the arrangement preferably including a peripheral seal member for sealing a peripheral region of the workpiece from electroplating solution during processing.

Production of semiconductor integrated circuits and other semiconductive devices from semiconductor wafers typically requires formation of multiple metal layers on the wafer to electrically interconnect the various devices of the integrated circuit. Electroplated metals typically include copper, nickel, gold and lead. Electroplating is effected by initial formation of a so-called seed layer on the wafer in the form of a very thin layer of metal, whereby the surface of the wafer is rendered electrically conductive. This electroconductivity permits subsequent formation of a so-called blanket layer of the desired metal by electroplating. Subsequent processing, such as chemical mechanical planarization, removes unwanted portions of the metal blanket layer formed during electroplating, resulting in the desired patterned metal layer in a semiconductor integrated circuit or micro-mechanism being formed.

Several technical problems are typically associated with electroplating of semiconductor wafers. Utilization of discrete electrical contacts with the seed layer of the wafer, about the wafer perimeter, ordinarily produces higher current densities near the contact points than at other portions of the wafer. This non-uniform distribution of current across the wafer, in turn, causes non-uniform deposition of plated metallic material. Current thieving, effected by the provision of electrically-conductive elements other than those which contact the seed layer, can be employed near the wafer contacts to minimize such non-uniformity, but such thieving techniques add to the complexity of electroplating equipment, and increase maintenance requirements.

Another typical problem in connection with electroplating of wafers concerns efforts to prevent the electric contacts themselves from being plated during the electroplating process. Any material plated to the electrical contacts must be removed to prevent changing contact performance. While it is possible to provide sealing mechanisms for discrete electrical contacts, such arrangements typically cover a significant area of the wafer surface, and can add complexity to the electrical contact design.

It is sometimes desirable to prevent electroplating on the exposed barrier layer near the edge of the semiconductor wafer. Electroplated material may not adhere well to the exposed barrier layer material, and is therefore prone to peeling off in subsequent wafer processing steps.

Finally, the specific metal to be electroplated can complicate the electroplating process. For example, electroplating of certain metals typically requires use of a seed layer having a relatively high electrical resistance. As a consequence, use of the typical plurality of electrical wafer contacts (for example, six (6) discrete contacts) may not provide adequate uniformity of the plated metal layer on the wafer.

The present invention is directed to an improved electroplating apparatus having a plating contact, and associated seal member, wherein the contact is configured to provide substantially continuous electrical contact with the associated wafer or like workpiece, with the seal member desirably providing continuous sealing of the peripheral region of the wafer from the electroplating solution.

BRIEF SUMMARY OF THE INVENTION

A plating apparatus having a plating contact embodying the principles of the present invention is configured for effecting electroplating of an associated semiconductor wafer, or like workpiece. The plating contact is provided in the form of an annular contact ring which is preferably configured to provide substantially continuous electrical contact with an electrically conductive seed layer of an associated workpiece, thereby promoting efficient and uniform electroplating. The arrangement includes an annular seal member mounted on the annular contact ring, with the seal member configured to continuously sealingly engage the associated workpiece, thereby isolating a peripheral region of the workpiece from the electroplating solution circulated within the electroplating apparatus. The plating apparatus is configured to receive the workpiece, and move the workpiece against the contact ring for processing. While the apparatus is illustrated in a configuration for effecting electroplating of the workpiece, an apparatus embodying the present invention can be configured for other (i.e., electroless) plating processing.

In accordance with the illustrated embodiment, the annular contact ring includes an annular mounting portion for operative connection with a rotatably driven rotor assembly of the electroplating apparatus. The contact ring further includes an annular, electrically-conductive contact portion which extends inwardly of the mounting portion, and is configured for substantially continuous electrically-conductive contact with a peripheral region of the associated workpiece. In one illustrated embodiment, the contact ring is configured to provide continuous, uninterrupted electrical-conductive contact with the peripheral portion of the workpiece. In an alternate embodiment, the contact ring includes a relatively large plurality (i.e., 20 or more) of discrete electrical contact regions, formed either unitarily (i.e., as one piece) or integrally (i.e., as separate integrated components) with the annular contact ring to provide substantially continuous electrical contact with the associated workpiece.

The annular seal member of the present construction is mounted on the annular contact ring, and includes a resiliently deformable annular seal lip adjacent to the contact portion of the contact ring. The seal lip initially projects beyond the contact portion in a direction toward the workpiece, so that the seal lip is resiliently biased into continuous sealing engagement with the peripheral of the workpiece when the workpiece is positioned in electrically-conductive contact with the contact portion of the contact ring. In one illustrated embodiment, the deformable seal lip has an inside dimension which is less than the inside dimension of the contact portion of the contact ring. In this arrangement, the seal lip acts to engage the workpiece inwardly of the contact portion, thereby isolating the contact portion from plating solution in the electroplating apparatus. In an alternate embodiment, the seal lip has an inside dimension greater than the inside dimension of the contact portion, whereby the contact portion engages the workpiece inwardly of the seal lip.

While the illustrated embodiments of the present invention illustrate the annular contact ring and annular seal member as circular, it is within the purview of the present invention that they can be otherwise shaped.

In the preferred form, an arrangement is provided for releaseably retaining the annular seal member on the annular contact ring. In accordance with the illustrated embodiments, at least one retention projection is provided on one of the contact ring and the seal member, with at least one recess defined by the other of the contact ring and the seal member for releaseably, resiliently receiving the retention projection. In the illustrated embodiments, the annular seal member is provided with a substantially continuous retention projection, with the polymeric or elastomeric material from which the annular seal member is formed facilitating resiliently deformable disposition of the retention projection in a continuous tension recess defined by the annular contact ring.

A plating apparatus embodying the principles of the present invention includes an improved rotor assembly particularly configured for efficient handling of a workpiece, and for positioning of the workpiece in electrically conductive contact with the associated plating contact. The apparatus includes a reactor vessel for containing a plating solution, and a rotor assembly for receiving the workpiece for positioning in contact with the solution. The rotor assembly includes a housing, and an annular contact member, which can be configured in accordance with the present disclosure, joined to the housing. The housing and contact member together define an opening through which the workpiece is transversely moveable, in a first direction, for positioning in the rotor assembly.

The rotor assembly further includes a moveable backing member, and an arrangement for reciprocably moving the backing member toward and away from the contact member generally perpendicular to the first direction. In this manner, the workpiece is positionable in the rotor assembly by movement first through the opening, and is thereafter urged into contact with the contact member by movement of the backing member against the workpiece.

In the illustrated embodiment, the reactor vessel includes an anode positioned therein, with the contact member joined in electrically conductive relationship with the workpiece which functions at the cathode to effect electroplating of the workpiece. However, it is within the purview of the present invention to configure the present apparatus, including the illustrated rotor assembly, for electro-less plating, that is, chemical plating without creation of an electrical potential between the plating solution and the workpiece.

In order to promote uniformity of plating, it is desirable that the workpiece be in substantially uniform electrical contact with the contact member. To this end, at least one of the contact member and the backing member comprises compliant material, preferably elastomeric material, to promote contact between a peripheral portion of the workpiece and the annular contact member. In accordance with the illustrated embodiment, the peripheral seal member is mounted on the contact member for sealing the peripheral portion of the workpiece from contact with the associated plating solution.

The arrangement for moving the backing member toward and away from the annular contact member preferably comprises at least one spring for biasing the backing member toward the contact member, and at least one actuator for moving the backing member in opposition to the biasing spring. In the illustrated embodiment, a plurality (three) of biasing springs are employed, with a plurality (three) of pneumatic actuators provided for effecting movement of the backing member in opposition to the springs. In the illustrated embodiment, an actuation member comprising an actuation ring is provided which is joined to the backing member, with the biasing springs acting against the actuation member for biasing the backing member against the contact member. A coupling arrangement is provided for detachably coupling the actuation member to the one or more pneumatic actuators, to thereby facilitate disassembly of the rotor assembly for maintenance and the like.

The present invention also contemplates a method of plating a workpiece, comprising the steps of providing a reactor vessel containing a plating solution, and providing a rotor assembly for receiving the workpiece for positioning in contact with the plating solution. The method includes the steps of positioning the workpiece in the rotor assembly between contact and backing members, and moving the backing member toward the contact member to urge the workpiece into contact therewith. Uniformity of plating is promoted by rotating the contact member, the backing member, and the workpiece while the workpiece is in contact with the plating solution. The rotor assembly includes a motor for effecting such rotation.

When the preferred configuration of the present invention, including a continuous peripheral seal, is employed for plating the workpiece, gas is typically formed at the surface of the workpiece which is in contact with the plating solution. In order to prevent the build-up of gas at this surface, it is preferred that the workpiece be positioned at an acute angle relative to the surface of the plating solution when the workpiece is positioned in contact therewith. In this fashion, gas formed at the workpiece surface can be dispersed, with this angular disposition permitting disbursement notwithstanding peripheral sealing of the workpiece.

Other features and advantages of the present invention will become readily apparent from the following detailed description, the accompanying drawings, and the appended claims.

DETAILED DESCRIPTION OF THE INVENTION

Figure 1:
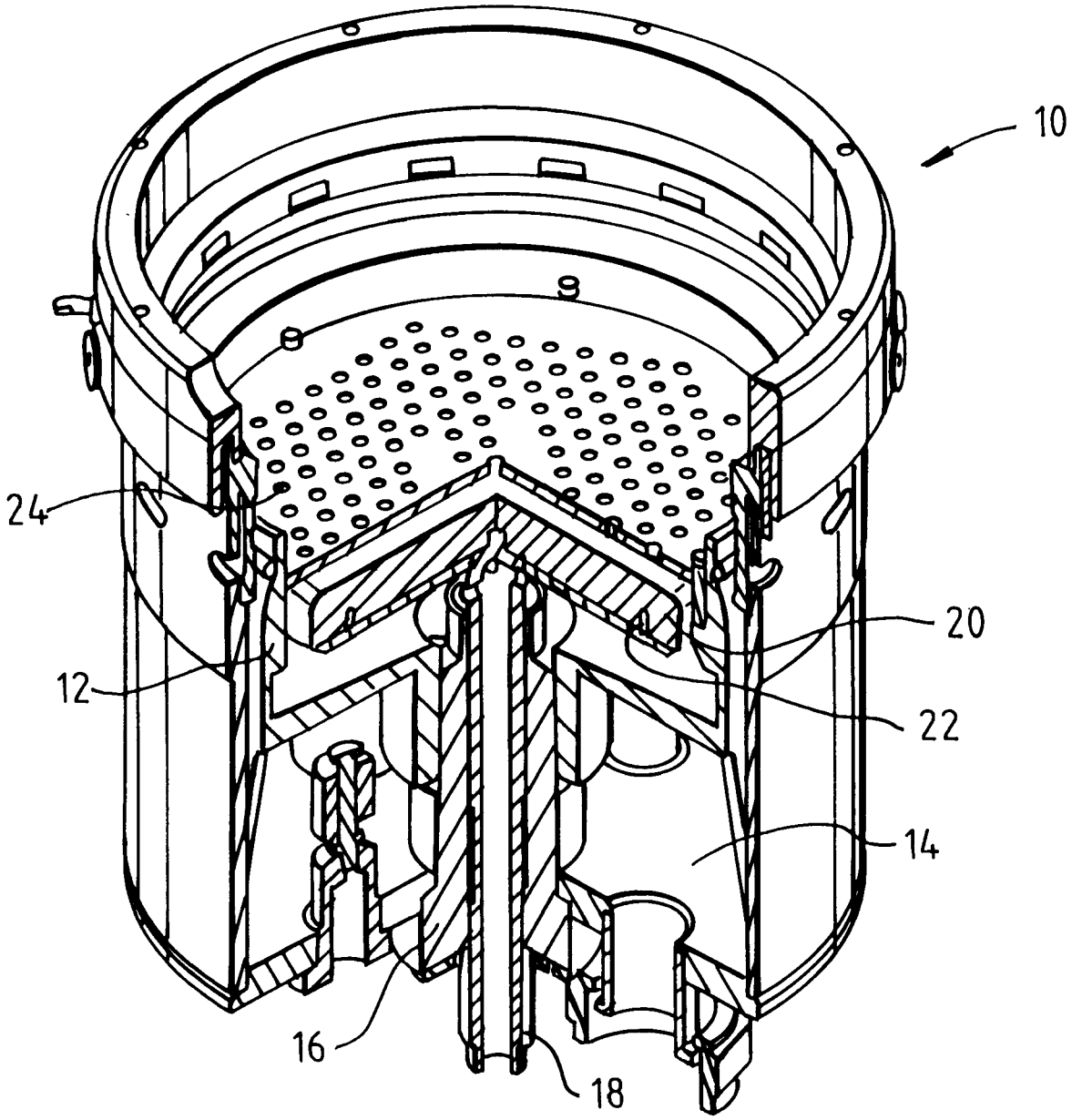
FIG. 1 is a perspective view, in partial cross-section, of a electroplating reactor of an electroplating apparatus embodying the principles of the present invention.

While the present invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

With reference first to FIG. 1, therein is illustrated an electroplating reactor 10 of an electroplating apparatus embodying the present invention. This type of electroplating apparatus is particularly suited for effecting electroplating of semiconductor wafers or like workpieces, whereby an electrically conductive seed layer of the wafer is electroplated with a metallic blanket or patterned layer.

The electroplating reactor 10 is that portion of the apparatus which generally contains electroplating solution, and which directs the solution against a generally downwardly facing surface of an associated workpiece to be plated. To this end, the reactor 10 includes a reactor vessel or cup 12 through which electroplating solution is circulated. Attendant to solution circulation, the solution flows from the reactor vessel 12, over the weir-like periphery of the vessel, into a lower overflow chamber 14 of the reactor 10. Solution is drawn from the overflow chamber typically for re-circulation through the reactor.

The reactor 10 includes a riser tube 16, within which an inlet conduit 18 is positioned for introduction of electroplating solution into the reactor vessel 12. The inlet conduit 18 is preferably conductive and makes electrical contact with and supports an electroplating anode 20. The anode 20 is preferably provided with an anode shield 22. Electroplating solution flows from the inlet conduit through openings at the upper portion thereof, about the anode 20, and through a diffusion plate 24 positioned in operative association with the anode. The anode may be consumable whereby metal ions of the anode are transported by the electroplating solution to the electrically-conductive surface of the associated workpiece, which functions as a cathode.

Figure 2:
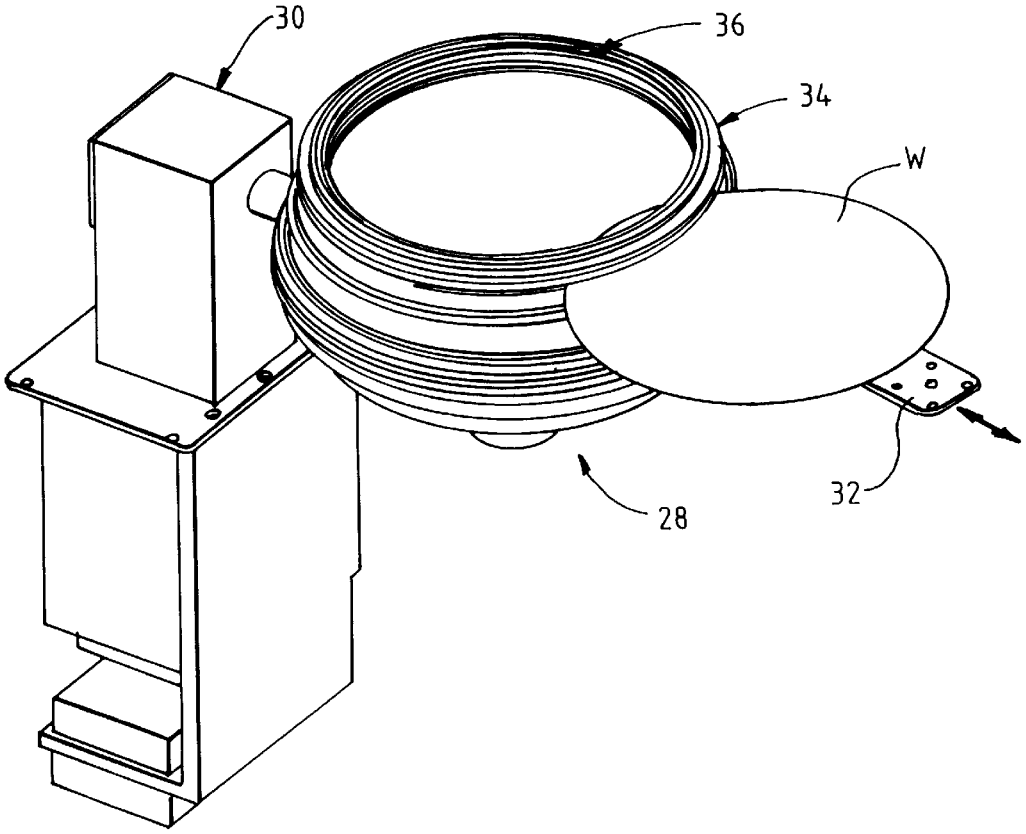
FIG. 2 is a perspective, diagrammatic view of further components of the present electroplating apparatus, including a rotatably driven rotor assembly.

The electroplating apparatus further includes a rotor assembly, diagrammatically illustrated in FIG. 2, and generally designated 28. Rotor assembly 28 is configured to receive and carry an associated wafer W or like workpiece, position the wafer in a downwardly facing orientation within reactor vessel 12, and to rotate or spin the workpiece while joining its electrically-conductive surface in the plating circuit of the apparatus. The rotor assembly 28 is typically mounted on a lift/rotate apparatus 30, which apparatus is configured to rotate the rotor assembly from an upwardly-facing disposition, wherein it receives the wafer to be plated, to a downwardly facing disposition, wherein the surface of the wafer to be plated is positioned downwardly in reactor vessel 12, generally in confronting relationship to diffusion plate 24. A robotic arm 32 (sometimes referred to as an end effector) is typically employed for placing the wafer W in position in the rotor assembly 28, and for removing the plated wafer from within the rotor assembly.

It will be recognized that other reactor assembly configurations may be used with the disclosed plating contact/sealing member, with the rotor assembly 28 described in further detail hereinafter.

Figure 3:
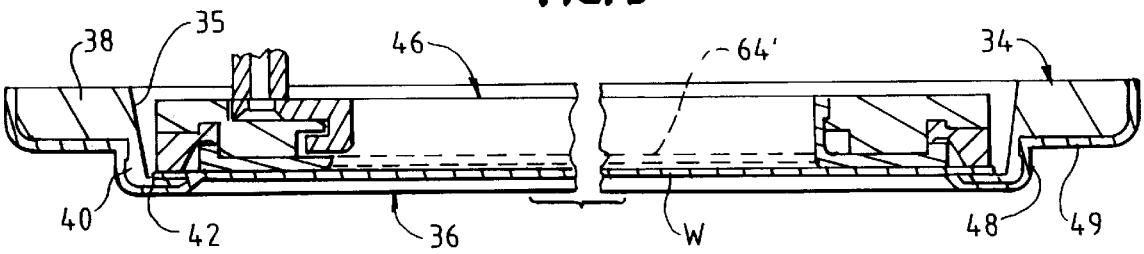
FIG. 3 is a cross-sectional view of a plating contact, with a peripheral seal member, embodying the principles of the present invention.
Figure 4:
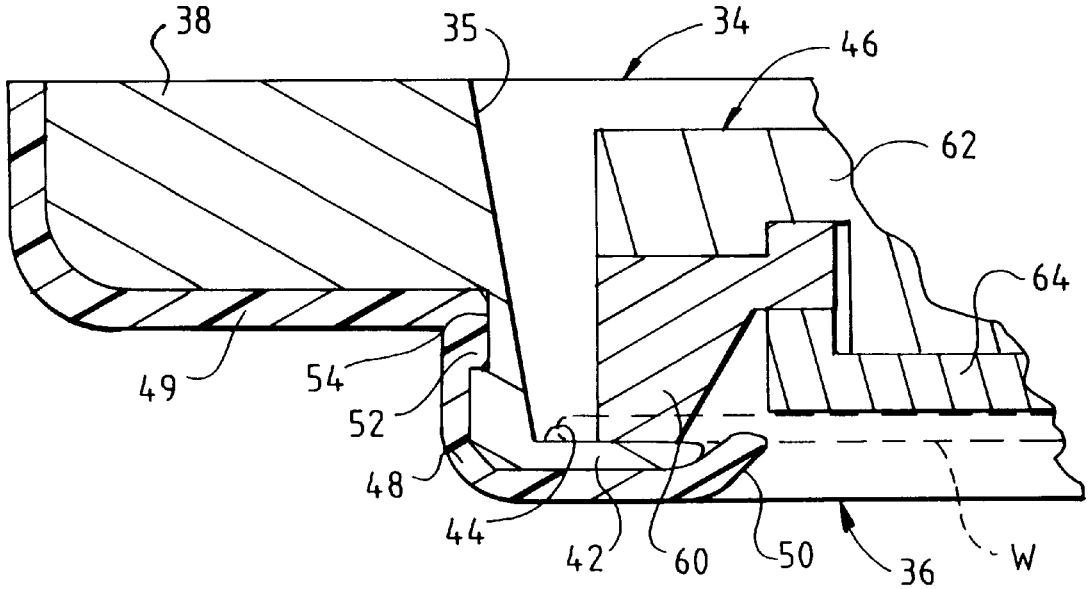
FIG. 4 is a relatively enlarged, fragmentary cross-sectional view of the plating contact and seal member illustrated in FIG. 3.

FIGS. 3 and 4 illustrate a plating contact and peripheral seal member embodying the principles of the present invention. The arrangement includes the plating contact, which is provided in the form of an annular contact member or ring 34 for mounting on the rotor assembly 28 of the electroplating apparatus. While the annular contact ring is illustrated as being circular in configuration, it will be understood that the annular contact ring can be non-circular in configuration. An annular seal member 36 is provided in operative association with the annular contact ring, and as will be further described, cooperates with the contact ring to provide continuous sealing of a peripheral region of the workpiece which is positioned in electrically-conductive contact with the annular contact ring.

The annular contact ring 34 includes a mounting portion 38 by which the contact ring is mounted for rotation on the rotor assembly 28 of the electroplating apparatus. The contact ring is also electrically joined with suitable circuitry provided in the rotor assembly, whereby the contact ring is electrically joined in the circuitry of the electroplating apparatus for creating the necessary electrical potential at the surface of the wafer W (the cathode) for effecting electroplating (by coaction with anode 20).

Figure 17:
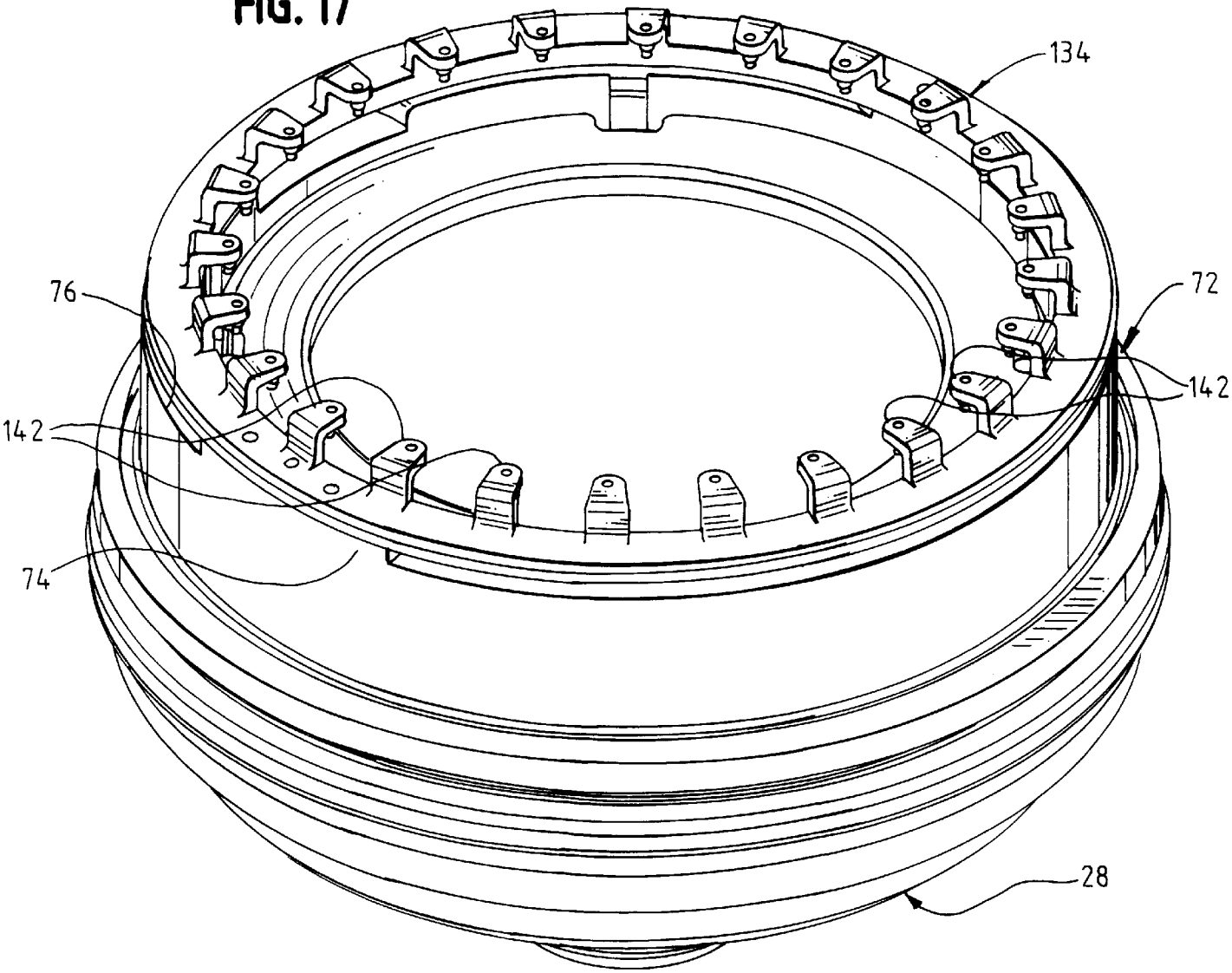
FIG. 17 is a perspective view of an alternate embodiment of an annular contact member of the present apparatus.

The annular contact ring further includes a depending support portion 40, and an annular contact portion 42 which extends inwardly of the mounting portion 38. The annular contact portion 42 defines a generally upwardly facing contact surface 44 which is engaged by the wafer W to establish electrical contact between the contact ring and the seed layer of the wafer. It is contemplated that the annular contact portion 42 of the contact ring provide substantially continuous electrically-conductive contact with a peripheral region of the associated wafer or other workpiece. While such electrical contact may be continuous, and uninterrupted, an alternate embodiment of the present invention shown in FIG. 17, comprises a rigid contact ring 134 including a relatively large plurality (20 or more) of discrete contact regions 142, formed either unitarily (i.e., as one piece) or integrally (i.e., as integrated separate components) with the contact ring. It is intended that such an arrangement provide the desired uniformity of current densities within the seed layer of the wafer about the periphery thereof, thereby promoting uniform deposition of the electroplated metal layer. In this alternate embodiment, twenty-four (24) of the discrete electrical contacts 142 are provided.

Planarity of the contacts 142 is controlled such that the workpiece is not stressed excessively as it is urged into contact therewith by associated components of the rotor assembly. This alternate embodiment can be utilized for both patterned and blanket plating applications. Auxiliary current thieving geometry can be affixed near the contact ring members, or local thieving near the contact points can be accomplished by selectively masking or exposing portions of the contact ring structure which are immersed in the plating solution bath during the plating process.

With reference again to FIGS. 3 and 4, the annular contact ring 34 is preferably configured to promote centering of workpiece W on the contact ring and its associated seal member. The contact ring preferably includes an inwardly facing conic guide surface 35 for guiding the workpiece into centered (i.e., concentric) relationship with the contact ring and associated seal member. The conic guide surface 35 acts as an angled lead-in (preferably angled between about 2 degrees and 15 degrees from vertical) on the contact ring inner diameter to precisely position the outside diameter of the workpiece on the contact diameter (i.e., ensure that workpiece is as concentric as possible on the contact ring). This is important for minimizing the overlap of the contact and its associated seal onto the surface of the workpiece, which can be quite valuable if it comprises a semiconductor wafer.

The annular seal member 36 of the present construction is positioned in operative association with the annular contact ring 34, whereby a peripheral region of the wafer W is sealed from electroplating solution in the electroplating apparatus. The wafer W can be held in position for electrical contact with the annular contact ring 34 by an associated backing member 46, with disposition of the wafer in this fashion acting to position the wafer in resilient sealing engagement with the peripheral seal member 36.

The peripheral seal member 36 is preferably formed from polymeric or elastomeric material, preferably a fluoroelastomer such as AFLAS, available from the 3M Company. The seal member 36 preferably includes a portion having a substantially J-shaped cross-sectional configuration. In particular, the seal member 36 includes a generally cylindrical mounting portion 48 which fits generally about support portion 40 of annular contact ring 34, and may include a skirt portion 49 which fits generally about mounting portion 38 of the contact ring. The seal member further includes a generally inwardly extending, resiliently deformable seal lip 50, with the mounting portion 38 of the seal lip 50 together providing the portion of the seal member having a J-shaped cross-sectional configuration. As illustrated in FIG. 4, the annular seal lip 50 initially projects beyond the contact portion 42 of the annular contact ring in a direction toward the wafer W or other workpiece. As a result, the deformable seal lip is resiliently biased into continuous sealing engagement with the peripheral region of the wafer when the wafer is positioned in electricallyconductive contact with the contact portion of the contact ring.

In the embodiment of the present invention illustrated in FIG. 4, the annular seal lip 50 has an inside dimension (i.e., inside diameter) less than an inside dimension (i.e., inside diameter) of the contact portion 42 of the annular contact ring 34. By this arrangement, the seal lip 50 engages the wafer radially inwardly of the contact portion 42, to thereby isolate the contact portion from plating solution in the electroplating apparatus. This arrangement is preferred when it is not only desirable to isolate a peripheral region of the wafer or other workpiece from the electroplating solution, but to also isolate the annular contact ring from the solution, thereby minimizing deposition of metal on the annular contact ring during electroplating.

The seal member 36 is preferably releaseably retained in position on the annular contact ring 34. To this end, at least one retention projection is provided on one of the seal member and contact ring, with the other of the seal member and contact ring defining at least one recess for releaseably retaining the retention projection. In the illustrated embodiment, the seal member 36 is provided with a continuous, annular retention projection 52, which fits within an annular recess 54 defined by annular contact ring 34. The polymeric or elastomeric material from which the seal member 36 is preferably formed promotes convenient assembly of the seal member onto the contact ring by disposition of the projection 52 in the recess 54.

As will be further described, the rotor assembly 28 of the present apparatus includes an actuation arrangement whereby the wafer or other workpiece W is received in the rotor assembly by movement in a first direction, and is thereafter urged into electrical contact with the contact ring 34 by movement of backing member 46 toward the contact ring, in a direction perpendicular to the first direction. In order to promote uniform electrical contact between the workpiece and the contact ring, without the excessive stressing of the workpiece, it is presently preferred that at least one of the contact ring and backing member comprise compliant material, preferably elastomeric material, to promote contact between the peripheral portion of the workpiece and the annular contact member. In the illustrated embodiment, the compliant elastomeric material is provided on the backing member 46, in the form of an annular elastomeric backing seal 60 fitted to an annular backing ring 62 of the backing member 46. The backing seal 60 is held in position on the backing ring 62 by a polymeric backing clip 64 which engages the backing ring in a snap-like fit for securing the backing seal 62 to the face of the backing member. By this arrangement, the backing member can be moved into engagement with the rearward face of the workpiece (which ordinarily is not subject to plating during processing), with the peripheral portion of the workpiece thus held in captive, sandwich-like relationship between the backing seal 60 and the annular contact portion 42 of the contact ring.

While the backing member 46 is shown in a ring-like configuration, open at the center thereof, the backing member can be configured to include a continuous shield portion, such as illustrated in phantom line in FIG. 3 and 64', for covering the rearward surface of the workpiece. The provision of this shield portion, as well as the provision of backing seal 60, acts to shield and protect the rearward surface of the workpiece from exposure to the chemical environment of the plating apparatus, including the plating solution in reactor vessel 10.

Figure 5:
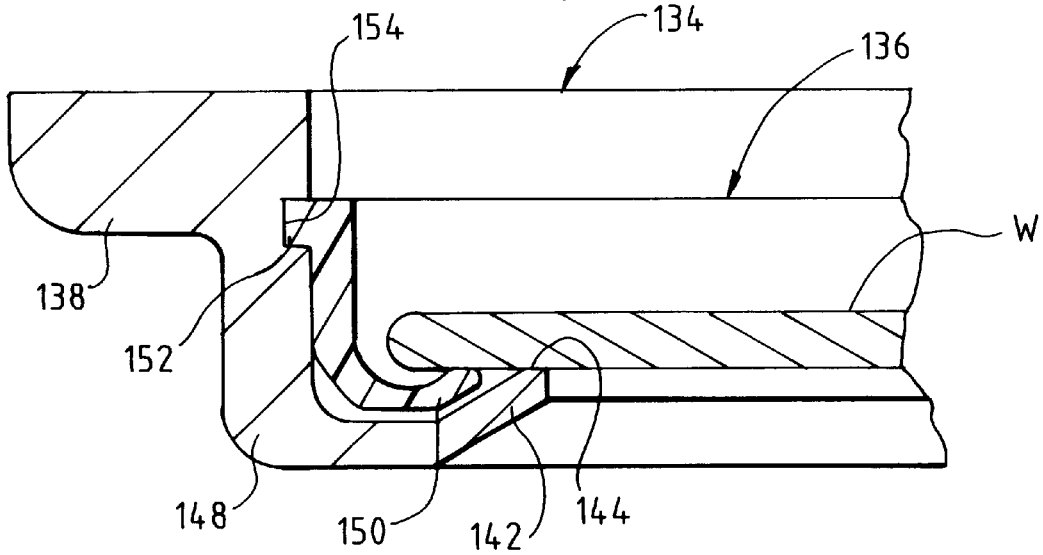
FIG. 5 is a view similar to FIG. 4 illustrating an alternate embodiment of the present plating contact and peripheral seal member.

With reference now to FIG. 5, therein is illustrated an alternate embodiment of the present contact ring and peripheral seal member, with elements of this embodiment corresponding to those of the above-described embodiment designated by like reference numerals in the one-hundred series.

FIG. 5 illustrates an annular contact ring 134 embodying the principles of the present invention, including a mounting portion 138, a depending support portion 140, and an inwardly extending annular contact portion 142, having a contact surface 144 configured for electrically-conductive contact with a peripheral region of an associated wafer W or other workpiece. This embodiment differs from the previously-described embodiment, in that the associated peripheral seal member, designated 136, including a seal lip that engages the workpiece outwardly (rather than inwardly of) the associated annular contact ring.

The annular seal member 134 has a generally J-shaped cross-sectional configuration, and includes a generally cylindrical mounting portion 148, and a resiliently deformable annular seal lip 150 which extends radially inwardly of the mounting portion. As in the previous embodiment, the deformable seal lip 150 initially projects beyond the contact portion 142 in a direction toward the wafer W, so that the seal lip 150 is resiliently biased into continuous sealing engagement with the peripheral region of the wafer when the wafer is positioned in electrically-conductive contact with the contact portion 142 of the contact ring 134. In this embodiment, the seal ring 150 has an inside dimension (i.e., inside diameter) greater than the inside dimension (i.e., inside diameter) of the annular contact portion 42. By this arrangement, the annular contact portion engages the workpiece radially inwardly of the seal lip. Attendant to positioning of the wafer W in electrically-conductive contact with the annular contact portion 142, the deformable seal lip 150 of the peripheral seal member is deformed generally axially of the cylindrical mounting portion 148 thereof. The seal member is thus maintained in sealing contact with the peripheral portion of the wafer, whereby edge and rear surfaces of the wafer are isolated from plating solution within the electroplating apparatus.

As in the previous embodiment, the peripheral seal member 136 is configured for releasable retention generally within the annular contact ring 134. To this end, the annular seal member 136 includes a continuous annular retention projection 152 which is releaseably retained within a continuous annular recess 154 defined by the annular contact ring 134. This arrangement promotes efficient assembly of the seal member and contact ring.

The features of the rotor assembly 28 for effecting movement of the backing member 46 will now be described. With particular reference to FIGS. 6 through 12, therein is illustrated a detachable portion of the rotor assembly, which portion is rotatably driven by a motor of the rotor assembly for plating processing. The detachable portion, generally designated 70, includes the above-described annular contact ring 34, and associated seal member 36, as well as the relatively movable backing member 46 which cooperates with the contact member and seal for gripping a workpiece during processing, thus providing the desired electrical contact and sealing cooperation with the workpiece.

Detachable portion 70 of the rotor assembly includes a generally annular housing assembly, including an outer housing 72 and an inner housing 73. The outer housing 72 includes a pair of mounting struts 74 to which the contact ring 34 and seal member 36 are mounted. By this arrangement, the housing assembly and the contact ring 34 (and seal 36) together define an opening 76 (see FIGS. 13 and 14) through which the workpiece W is transversely movable, in a first direction, for positioning the workpiece in the rotor assembly. The outer housing 72 preferably defines a clearance opening 78 for robotic arm 32, as well as a plurality of workpiece supports 80 upon which the workpiece is positioned by the robotic arm after the workpiece is moved transversely into the rotor assembly by movement through opening 76 (see FIGS. 13 and 14). The supports 80 thus support the workpiece between the contact ring 34 and the backing member 46 before the backing member engages the workpiece and urges it against the contact ring.

Reciprocable movement of the backing member 46 relative to the contact ring 34 is effected by at least one spring which biases the backing member toward the contact ring, and at least one actuator for moving the backing member in opposition to the spring. In the illustrated embodiment, the actuation arrangement includes an actuation ring 82 which is operatively connected with the backing member 46, and which is biased by a plurality of springs, and moved in opposition to the springs by a plurality of actuators.

Figure 6:
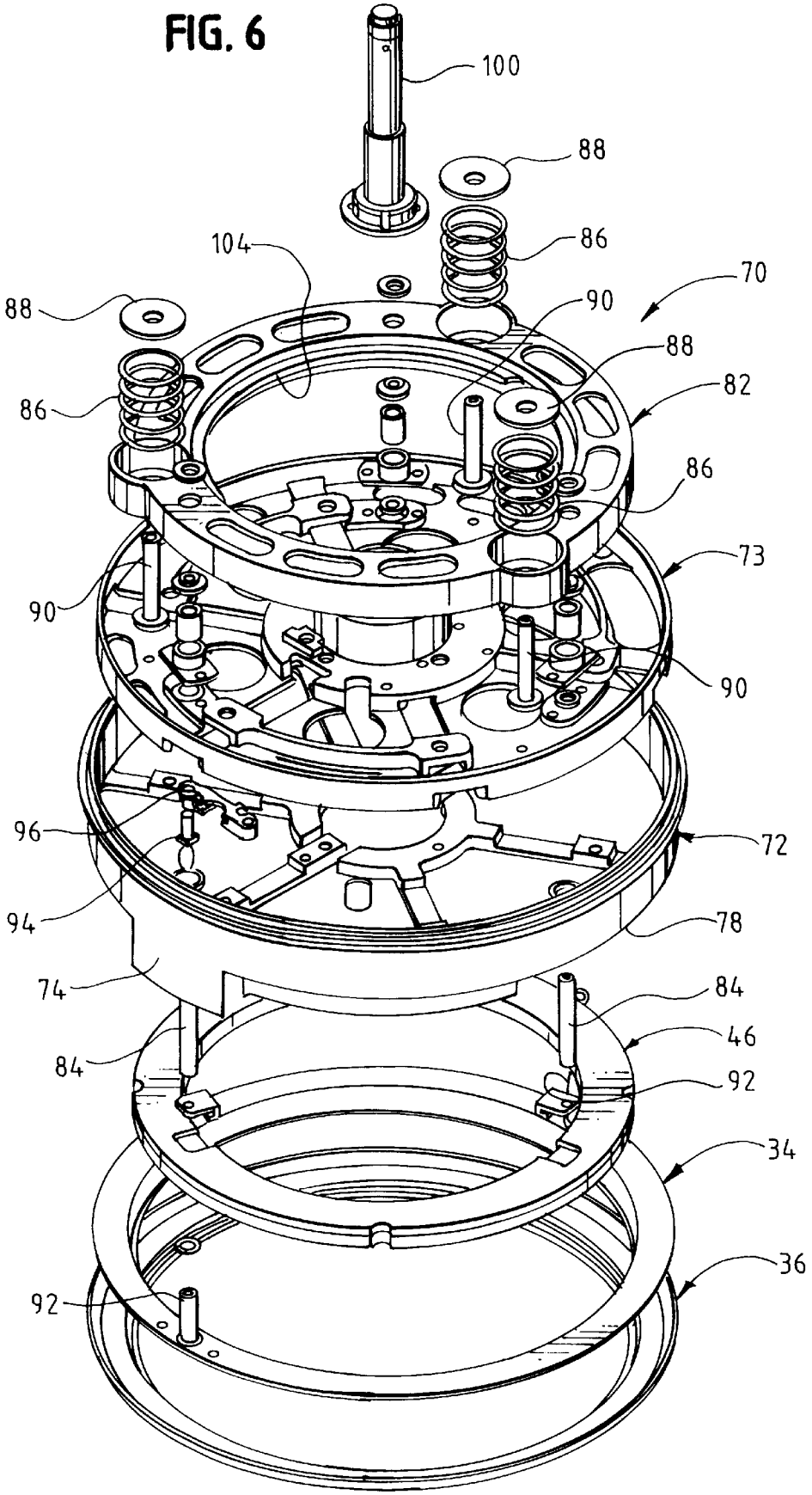
FIG. 6 is an exploded perspective view of a rotatably driven detachable portion of the rotor assembly of the present apparatus which receives an associated workpiece for processing.

With particular reference to FIG. 6, actuation ring 82 is operatively connected to the backing member 46 by a plurality (three) of shafts 84. The actuation ring, in turn, is biased toward the housing assembly (including inner and outer housings 72, 73) by three compression coil springs 86 which are each held captive between the actuation ring and a respective retainer cap 88. Each retainer cap is held in fixed relationship with respect to the housing assembly by a respective retainer shaft 90. By this arrangement, the action of the biasing springs 86 urges the actuation ring 82 in a direction toward the housing 72, with the action of the biasing springs thus acting through shafts 84 to urge the backing member 46 in a direction toward the contact ring 34.

As noted above, the workpiece received within the rotor assembly functions as the cathode during an electroplating process, and to this end, the contact ring 34 is electrically joined to the circuitry which drives the plating apparatus. A pair of diametrically opposed contact sleeves 92 are joined to the contact ring 34, with each contact sleeve receiving therein, in electrically conductive relationship, a respective one of a pair of plugs 94 mounted on the housing 72 by respective clips 96. Each of the plugs 94, in turn, is electrically joined by suitable wiring to a central conductor 98 positioned within drive shaft 100. The conductor 98 is electrically joined to a rotary electrical connector at the end of drive shaft 100 for operative connection with the circuitry of the plating apparatus. It is preferred that clips 96 permit limited free play or "float" of plugs 94, thus facilitating self-alignment and the desired electrical connection with contact sleeves 92 during assembly of the apparatus.

The drive shaft 100 is operatively connected to inner housing 73 for effecting rotation of workpiece W, as it is held between contact ring 34 and backing member 46, during plating processing. The drive shaft 100, in turn, is driven by motor 102 of the rotor assembly 28.

As noted above, detachable portion 70 of the rotor assembly of the present apparatus, which portion 70 rotates during processing, is preferably detachable from the remainder of the rotor assembly to facilitate maintenance and the like. Thus, drive shaft 100 is detachably couplable with the motor 102. In accordance with the preferred embodiment, the arrangement for actuating the backing member 46 also includes a detachable coupling, whereby actuation ring 82 can be coupled and uncoupled from associated actuators which act in opposition to biasing springs 86.

Figure 7:
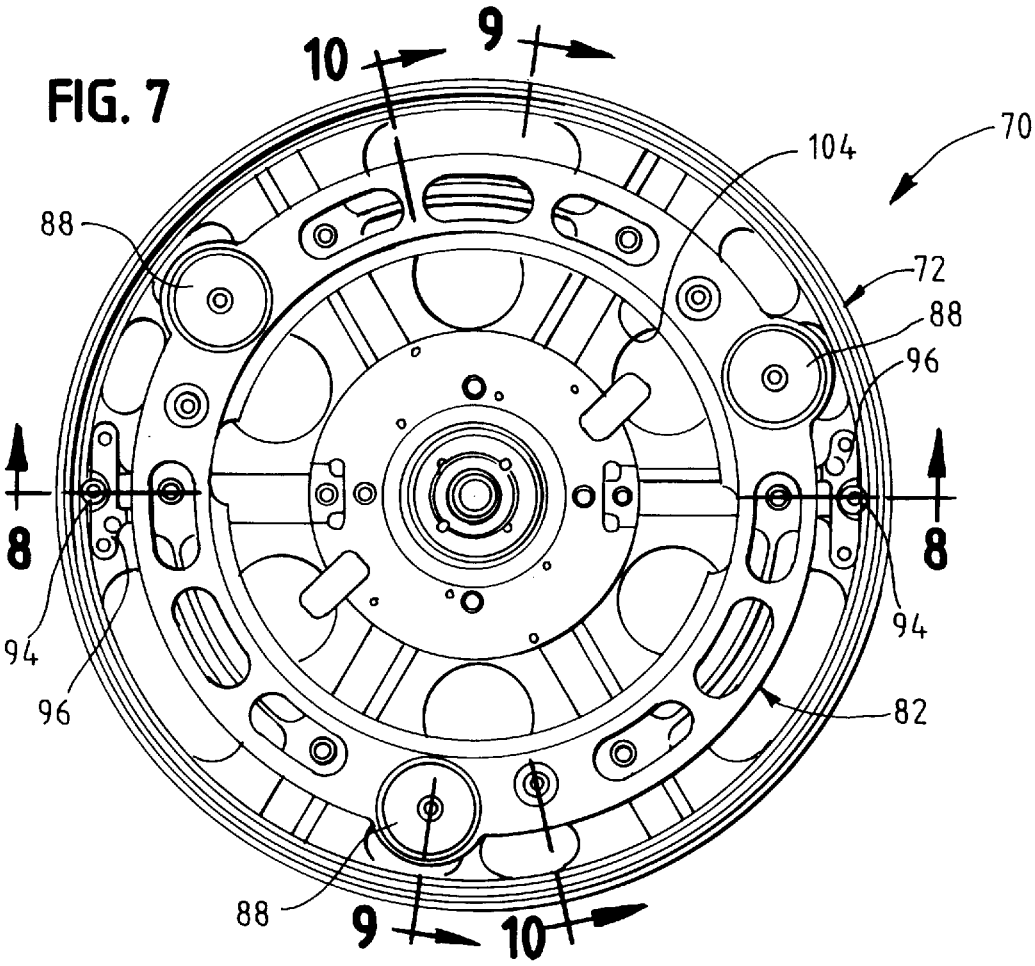
FIG. 7 is a plan view of the portion of the rotor assembly shown in FIG. 6.
Figure 8:
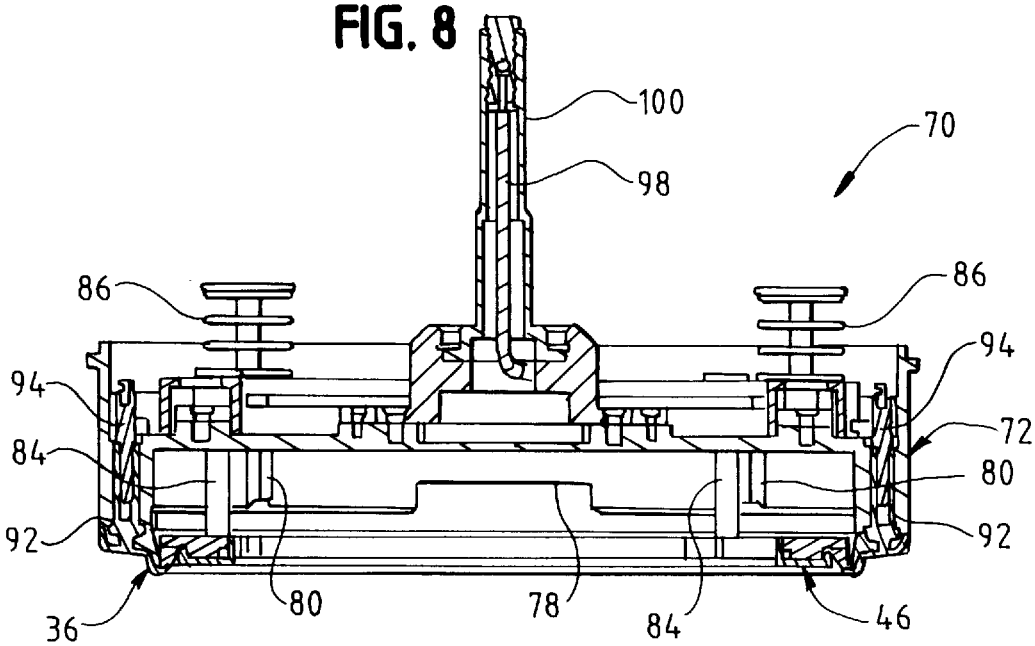
FIG. 8 is a cross-sectional view taken along line 8—8 of FIG. 7.
Figure 9:
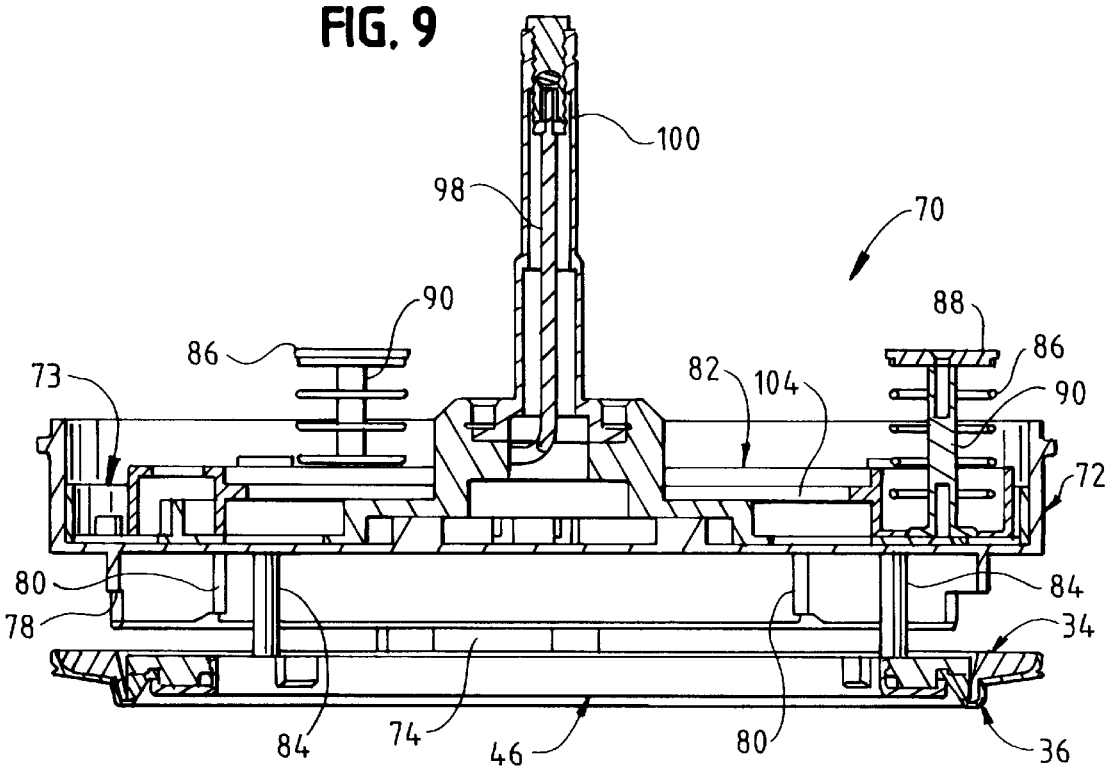
FIG. 9 is a cross-sectional view taken along line 9—9 of FIG. 7.
Figure 10:
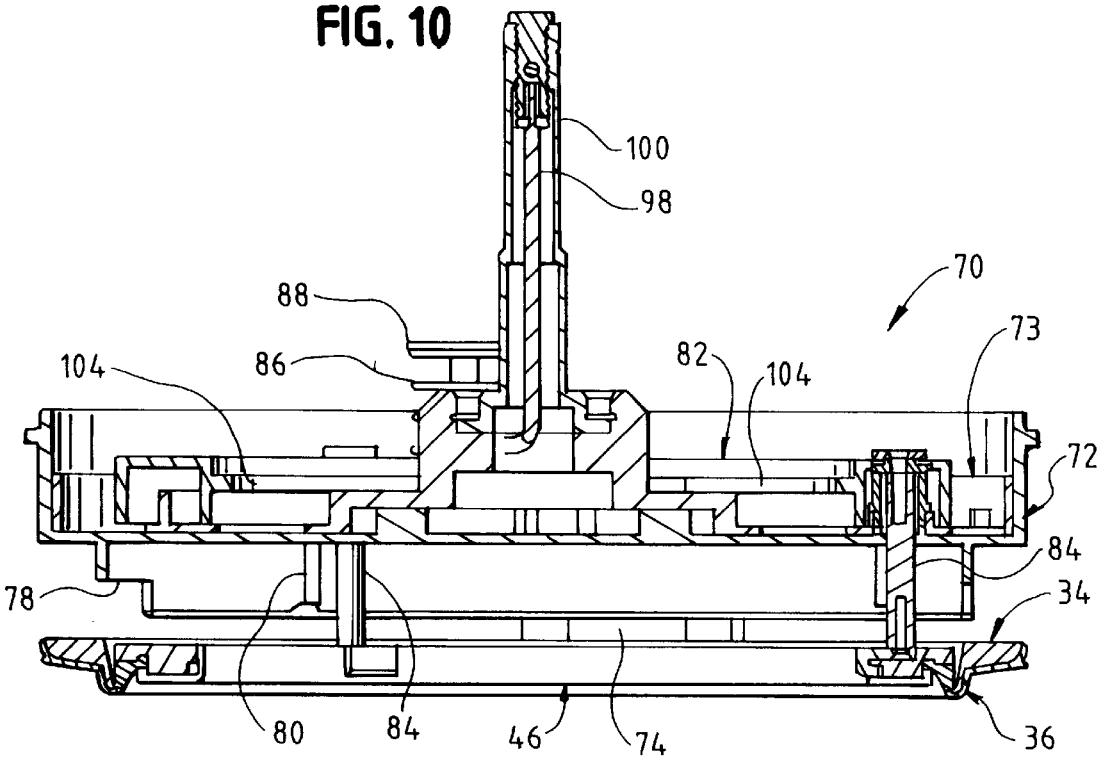
FIG. 10 is a cross-sectional view taken along line 10—10 of FIG. 7.
Figure 11:
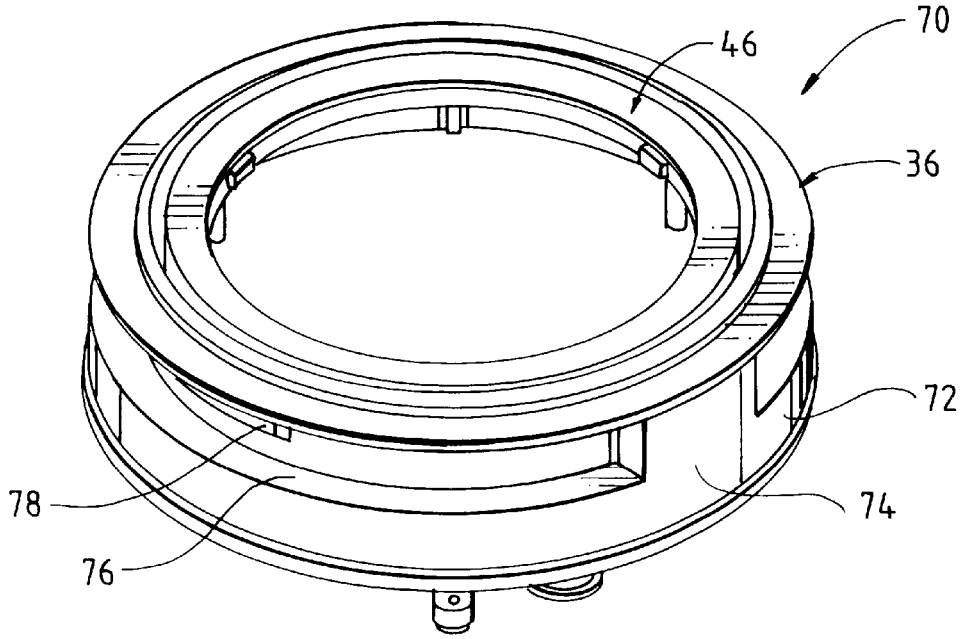
FIG. 11 is a perspective view illustrating the detachable portion of the rotor assembly shown in FIG. 6.
Figure 12:
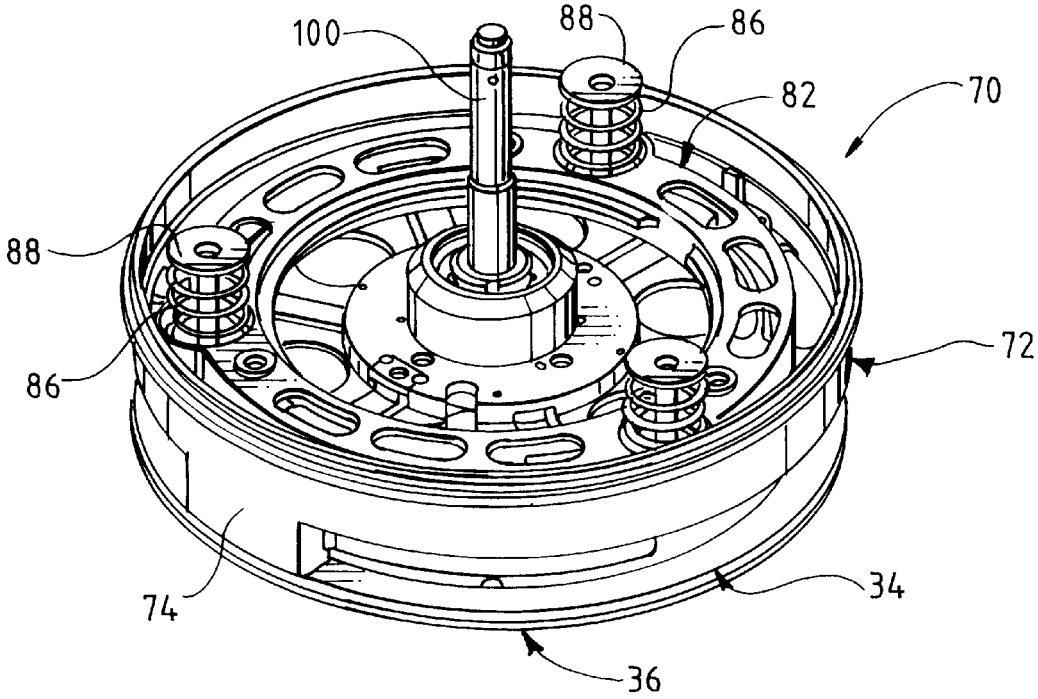
FIG. 12 is a further perspective view of the detachable portion of the rotor assembly shown in FIG. 11.
Figure 15:
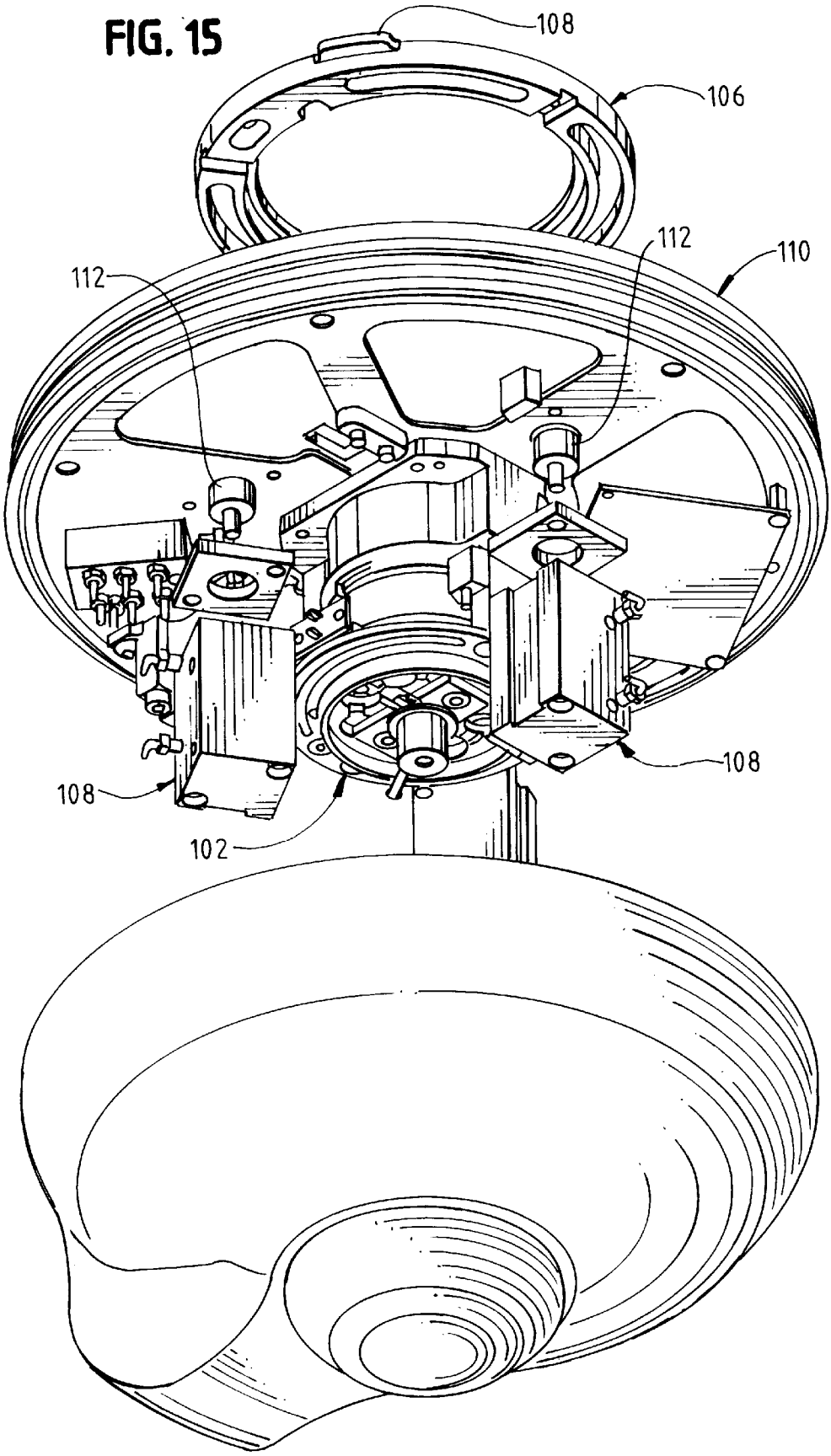
FIG. 15 is a partially exploded perspective view of the drive of the rotor assembly of the present apparatus.
Figure 16:
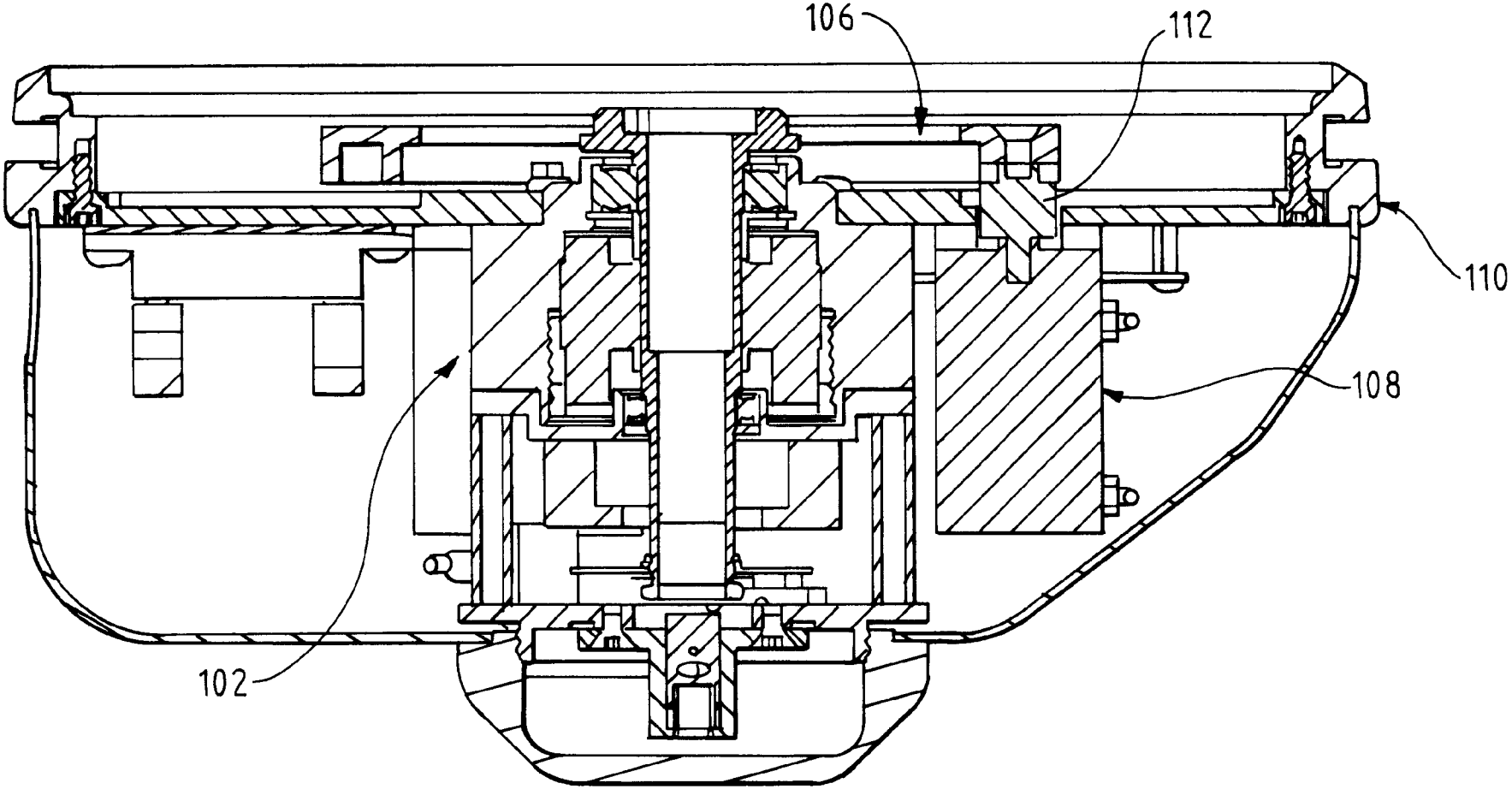
FIG. 16 is a further cross-sectional view of the rotor assembly of the present apparatus.

As illustrated in FIGS. 6 and 7, actuation ring 82 includes an inner, interrupted coupling flange 104. Actuation of the actuation ring 82 is effected by an actuation coupling 106 (FIG. 15) of the rotor assembly which can be selectively coupled and uncoupled from the actuation ring 82. The actuation coupling 106 includes a pair of flange portions 108 which can be interengaged with coupling flange 104 of the actuation ring 82 by limited relative rotation therebetween.

By this arrangement, the actuation ring 82 of the detachable portion 70 can be coupled to, and uncoupled from, the actuation coupling 106 of the rotor assembly.

Actuation coupling 106 is movable in a direction in opposition to the biasing springs 86 by a plurality of pneumatic actuators 108 mounted on a frame 110 of the rotor assembly. Each actuator 108 is operatively connected with the actuation coupling 106 by a respective drive member 112, each of which extends generally through the frame 110 on which motor 102 is mounted.

Figure 13:
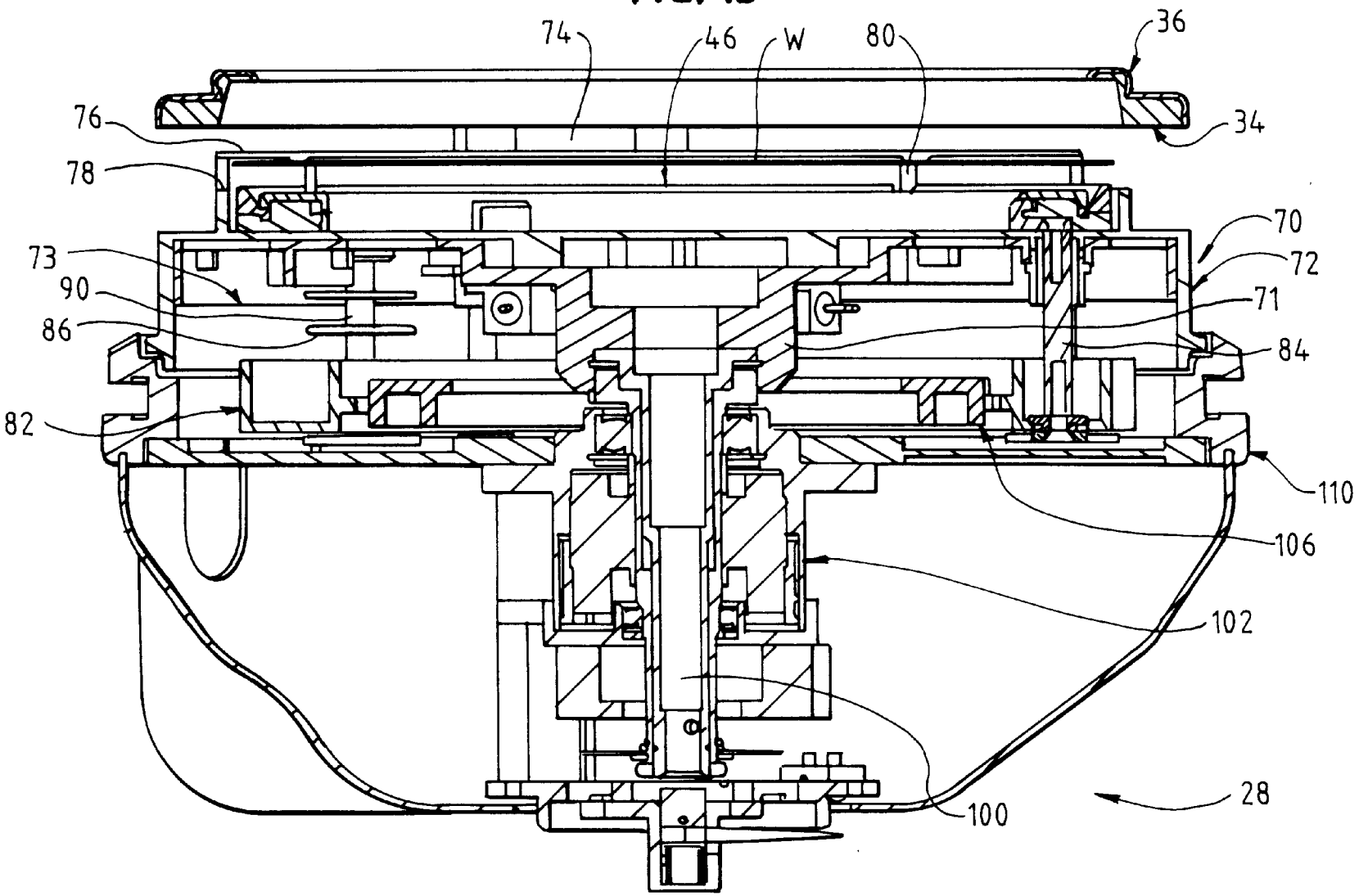
FIG. 13 is a cross-sectional view of the rotor assembly of the present apparatus, illustrated in a workpiece loading position.

Operation of the rotor assembly 28 will be appreciated from the above description. Loading of workpiece W into the rotor assembly is effected with the rotor assembly in a generally upwardly facing orientation, such as illustrated in FIGS. 2 and 13. Workpiece W is moved transversely through the opening 76 defined by the rotor assembly to a position wherein the workpiece is positioned in spaced relationship generally above supports 80. The robotic arm 32 is then lowered (with clearance opening 78 accommodating such movement), whereby the workpiece is positioned upon the supports 80. The robotic arm can then be withdrawn from within the rotor assembly.

Figure 14:
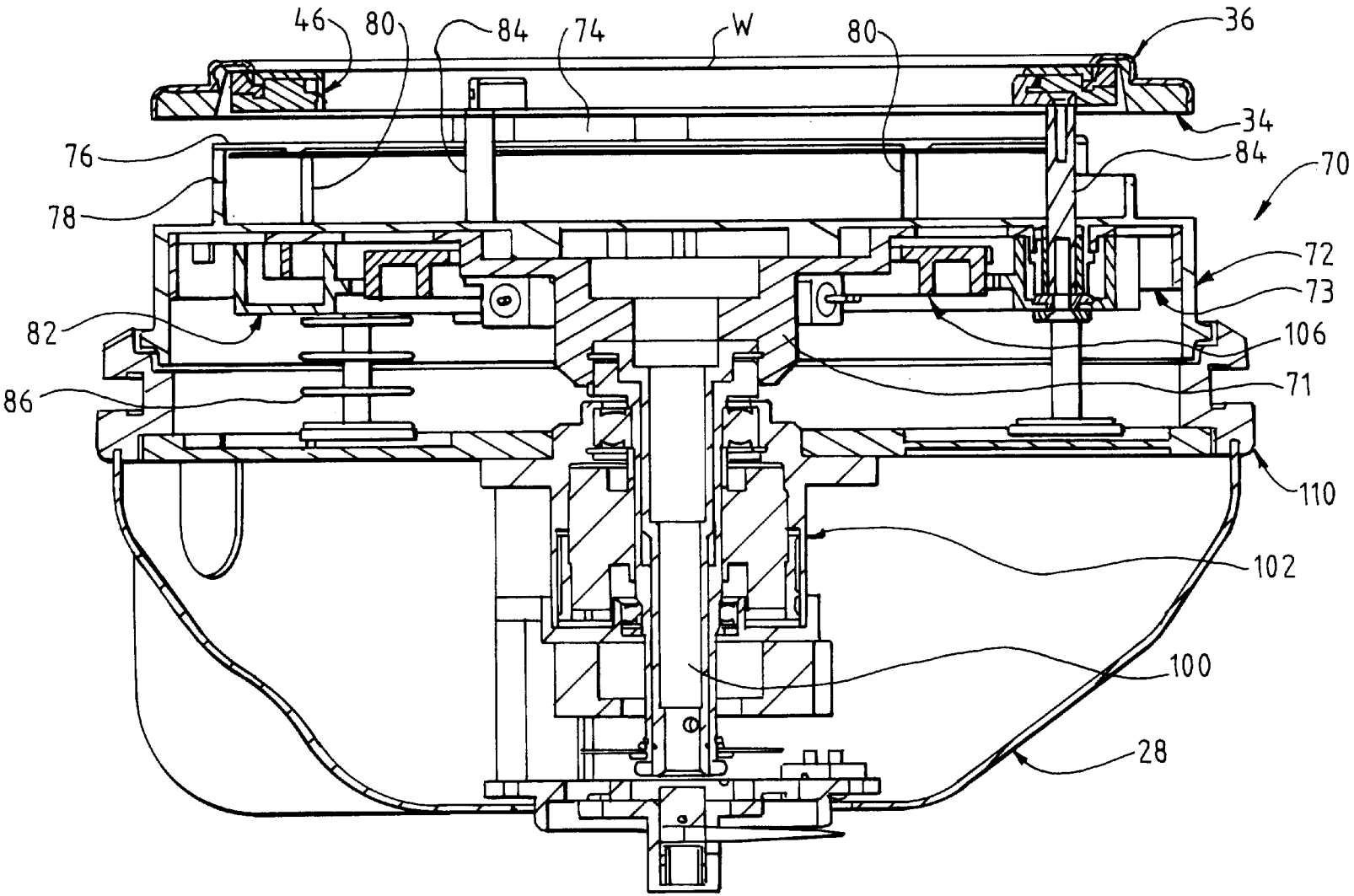
FIG. 14 is a cross-sectional view of the rotor assembly of the present apparatus shown in a workpiece processing position.

The workpiece is now moved perpendicularly to the first direction in which it is moved transversely into the rotor assembly. Such movement is effected by movement of backing member 46 generally toward contact ring 34 and seal member 36. It is presently preferred that pneumatic actuators 102 act in opposition to biasing springs 86 which are operatively connected by actuation ring 82 and shafts 84 to the backing member 46. Thus, actuators 108 are operated to permit springs 86 to bias and urge actuation ring 82, and thus backing member 46, toward contact ring 34. FIG. 13 illustrates the disposition of the workpiece W within the rotor assembly after it is received therein on supports 80, while FIG. 14 illustrates the disposition of the workpiece after it has been moved by backing member 46, under the influence of springs 86, into the processing position. As will be observed, the workpiece is moved into electrically conductive relationship with the contact portion 42 of the contact ring 34, with seal member 36 sealingly engaging the peripheral portion of the workpiece. The workpiece is held firmly in position against the contact member under the influence of springs 86, while pneumatic actuators 108 are depressurized.

In the preferred form, the connection between actuation ring 82 and backing member 46, by shafts 84, permits some "float", that is, the actuation ring and backing member are not rigidly joined to each other. This preferred arrangement accommodates the common tendency of the pneumatic actuators 108 to move at slightly different speeds, thus assuring that the workpiece is urged into substantial uniform contact with the contact member 34, while avoiding excessive stressing of the workpiece, or binding of the actuation mechanism.

Figure 18:
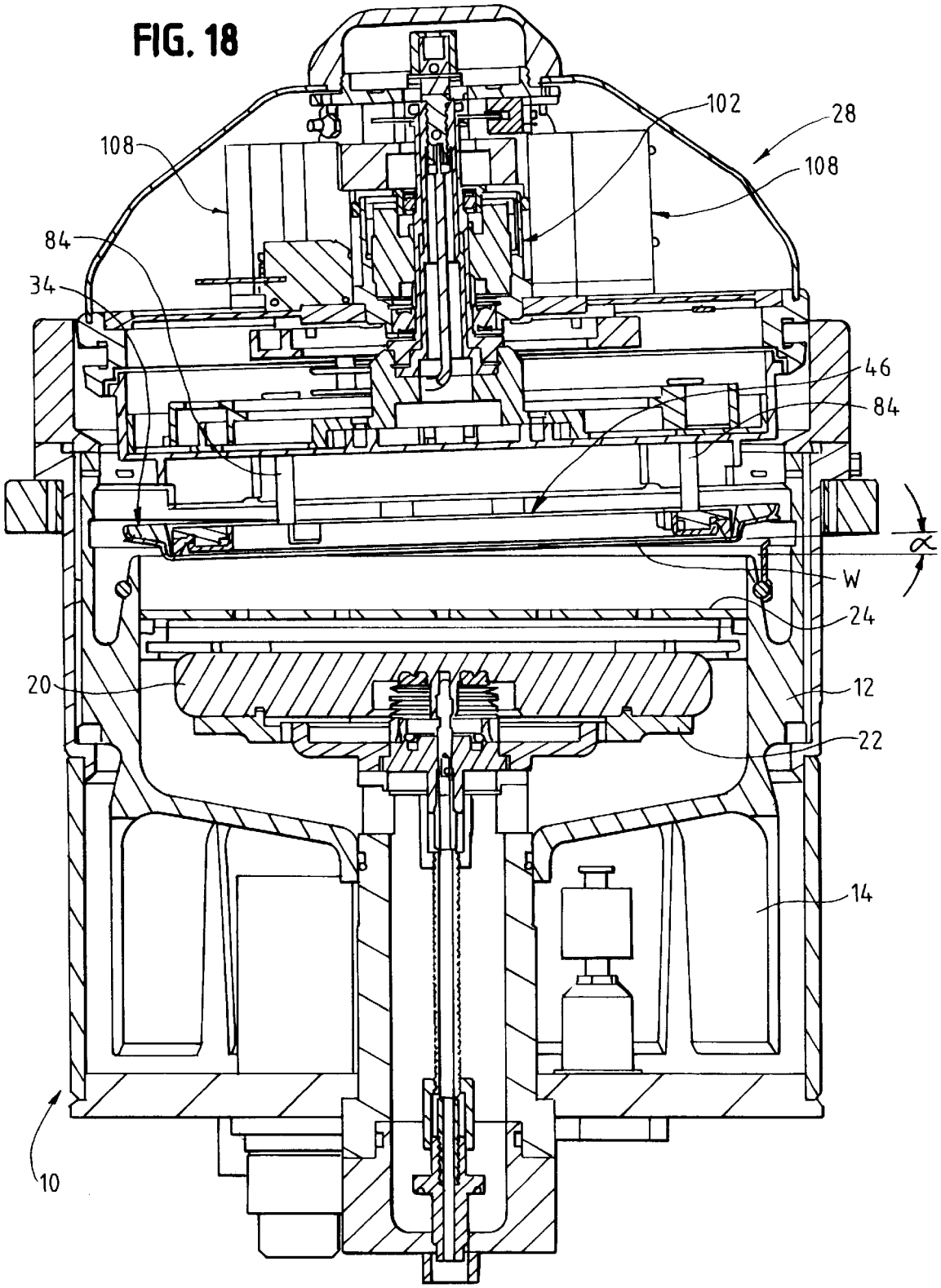
FIG. 18 is a diagrammatic view illustrating the present plating apparatus, with the rotor assembly and reactor vessel positioned together for workpiece processing.

With the workpiece firmly held between the backing member 46 and the contact ring 34 (and seal member 36), lift and rotate apparatus 30 rotates the rotor assembly 28, and rotates and lowers the rotor assembly into cooperative position with reactor vessel 12 so that the surface of the workpiece is placed in contact with plating solution within the reactor vessel. FIG. 18 illustrates the apparatus in this condition. Because the peripheral seal 36 acts to seal the entire peripheral region of the workpiece, it is important that any gas which accumulates on the surface of the workpiece be permitted to vent and escape. Accordingly, practice of the present invention contemplates that the surface of the workpiece be disposed at an acute angle (angle "alpha" in FIG. 18), such as on the order of two degrees from horizontal, with respect to the surface of the solution in the reactor vessel. This facilitates venting of gas from the surface of the workpiece during the plating process as the workpiece, and associated backing and contact members, are rotated in unison by motor 102 acting through drive shaft 100 and the housing assembly 72, 73. Circulation of plating solution within the reactor vessel, as electrical current is passed through the workpiece and the plating solution, effects the desired electroplating of a metal layer on the surface of the workpiece.

A number of features of the present invention facilitate efficient and cost-effective electroplating of workpieces such as semiconductor wafers. By use of a contact ring having substantially continuous contact, either in the form of continuous contact ring 34, or contact ring 134 having discrete contact regions, a high number of plating contacts are provided while minimizing the required number of components. The actuation of the backing member 46 is desirably effected by a simple linear motion, thus facilitating precise positioning of the workpiece, and uniformity of contact with the contact ring. The illustrated arrangement desirably minimizes the "penetrations" through the rotor assembly into the chemical environment within the reactor vessel, thereby desirably minimizing the required sealing of these regions. Disassemby is facilitated by the detachable configuration of the portion 70 of the rotor assembly, with the arrangement further facilitating the provision of different contact configurations by simply changing the contact ring 34, 134. The ring contact provides ideal distribution of contact onto the surface of the workpiece, while the preferred provision of the peripheral seal can protect the contact from plating solution, thereby desirably preventing build-up of plated material onto the electrical contacts. The perimeter seal also desirably prevents plating onto the peripheral portion of the workpiece. The contact assembly is desirably formed from a minimum number of components, and contact with the workpiece can be tightly controlled, which is important in those applications in which only a specified region of the workpiece is provided by electric contact.

From the foregoing, it will be observed that numerous modifications and variations can be made without departing from the true spirit and scope of the novel concept of the present invention. It will be understood that no limitation with respect to the specific embodiments illustrated herein is intended or should be inferred. The disclosure is intended to cover, by the appended claims, all such modifications as fall within the scope of the claims.

What is claimed is:

1. An electrical contact assembly for an apparatus for effecting electrochemical processing of a workpiece, comprising:

an annular contact for mounting on said apparatus, said annular contact having an annular mounting portion, and an annular electrically-conductive contact portion extending inward of said mounting portion, said contact portion being configured for electrically-conductive contact with a peripheral region of said workpiece at a substantial number of contact points; and an annular seal member mounted on said annular contact, the annular seal member comprising an annular seal lip formed entirely from a resiliently deformable material, the annular seal lip comprising an upstanding portion in fixed alignment with the annular mounting portion of the annular contact and a radially extending portion extending from the upstanding portion that terminates at an upstanding edge adjacent and radially interior to said contact portion of said annular contact, the annular seal lip generally deforming about one or more flex points on the upstanding portion of the annular seal lip as the workpiece is driven into engagement with the upstanding edge of the seal lip and into electrical contact with the contact portion of the annular contact so that said seal lip is resiliently biased into continuous sealing engagement with the peripheral region of said workpiece, such sealing engagement inhibiting contact between the contact portion of the annular contact and a processing fluid used in the electrochemical processing of the workpiece.

2. A plating contact in accordance with claim 1, wherein annular contact ring includes a conic guide surface for guiding said workpiece into centered relationship with said seal member.

3. A plating contact in accordance with claim 1, including means for releaseably retaining said seal member on said annular contact ring.

4. A plating contact in accordance with claim 3, wherein said retaining means comprises at least one retention projection on one of said contact ring and said seal member, and at least one recess defined by the other of said contact ring and said seal member for releaseably, resiliently receiving said retention projection.

5. An electrical contact assembly for an apparatus for effecting electrochemical processing of a workpiece, comprising:

an annular contact for mounting on said apparatus, said annular contact having an annular mounting portion, and an annular, electrically-conductive contact portion extending inwardly of said mounting portion and having a generally upwardly facing surface con figured for electrically-conductive contact with a peripheral region of said associated workpiece at a substantial number of contact points; and an annular seal member mounted on said annular contact, the annular seal member comprising an annular seal lip formed entirely from a resiliently deformable material selected from a group consisting of polymeric and elastomeric materials, the annular seal lip comprising an upstanding portion and a radially extending portion extending from the upstanding portion and terminating at an upstanding edge adjacent and radially interior to said contact portion of said annular contact, one of said annular contact and said annular seal member comprising at least one retention projection, and the other of said annular contact and said annular seal member defining at least one recess for resiliently receiving said retention projection to thereby join the upstanding portion of the annular seal member to the mounting portion of the annular contact, the annular seal lip generally deforming about one or more flex point on the upstanding portion of the annular sealing lip as the workpiece is driven into engagement with the upstanding edge of the seal lip and into electrical contact with the contact portion of the annular contact so that the sealing lip is resiliently biased into continuous sealing engagement with the peripheral region of said workpiece, such sealing engagement inhibiting contact between the contact portion of the annular contact and a processing fluid used in the electrochemical processing of the workpiece.

6. A plating contact in accordance with claim 5, wherein said contact portion of said contact ring is configured for continuous, uninterrupted electrically-conductive contact with the peripheral region of said workpiece.

7. A plating contact in accordance with claim 5, wherein said contact portion of said contact ring includes a plurality of discrete contact regions.

8. An electrical contact assembly for an apparatus for effecting electrochemical processing of a workpiece, comprising:

an integral contact member having an electrically conductive mounting portion and an electrically-conductive contact portion and electrical contact with and extending inward of the mounting portion, the contact portion having one or more contacts configured for electrically-conductive contact with a peripheral region of the workpiece at a substantial number of contact points; and an integral seal member comprising a seal lip formed entirely from a resiliently deformable material, the seal lip comprising an upstanding portion in fixed alignment with the mounting portion of the annular contact and a radially extending portion extending from the upstanding portion that terminates at an upstanding edge adjacent and radially interior to the one or more contacts of the contact portion of the integral contact, the seal lip generally deforming about one or more flex points of the upstanding portion of the seal lip as the workpiece is driven into engagement with the upstanding edge of the seal lip and into electrical contact with the contacts of the integral contact so that the seal lip is resiliently biased into continuous sealing engagement with the peripheral region of the workpiece to thereby inhibit contact between a processing fluid used to electrochemically process the workpiece and the contacts of the integral contact.

* * * * *